US007564411B2

(12) United States Patent
Piisila et al.

(10) Patent No.: US 7,564,411 B2
(45) Date of Patent: Jul. 21, 2009

(54) FREQUENCY TUNABLE PLANAR INTERNAL ANTENNA

(75) Inventors: Mika Piisila, Kempele (FI); Mauri Suvanto, Oulu (FI)

(73) Assignee: Flextronics AP, LLC, Broomfield, CO (US)

( * ) Notice: Subject to any disclaimer, the term of this patent is extended or adjusted under 35 U.S.C. 154(b) by 27 days.

(21) Appl. No.: 11/729,499

(22) Filed: Mar. 28, 2007

(65) Prior Publication Data

US 2007/0229381 A1 Oct. 4, 2007

Related U.S. Application Data

(60) Provisional application No. 60/787,449, filed on Mar. 29, 2006.

(51) Int. Cl.
*H01Q 1/24* (2006.01)
*H01Q 3/24* (2006.01)

(52) U.S. Cl. ..... 343/702; 343/876

(58) Field of Classification Search ..... 343/702, 343/700 MS, 767, 770, 876
See application file for complete search history.

(56) References Cited

U.S. PATENT DOCUMENTS

| | | | | |
|---|---|---|---|---|
| 5,764,190 | A | 6/1998 | Murch et al. | 343/702 |
| 6,140,966 | A * | 10/2000 | Pankinaho | 343/700 MS |
| 6,680,705 | B2 | 1/2004 | Tan et al. | 343/702 |
| 6,693,594 | B2 * | 2/2004 | Pankinaho et al. | 343/700 MS |
| 6,792,246 | B2 | 9/2004 | Takeda et al. | 455/41.1 |
| 7,026,996 | B2 | 4/2006 | Harano | 343/700 |
| 7,026,999 | B2 | 4/2006 | Umehara et al. | 343/702 |
| 7,119,743 | B2 | 10/2006 | Iguchi et al. | 343/700 |
| 7,319,432 | B2 | 1/2008 | Andersson | 343/702 |
| 2005/0007283 | A1 | 1/2005 | Jo et al. | 343/702 |
| 2005/0195124 | A1 | 9/2005 | Puente Baliarda et al. | 343/893 |
| 2007/0139280 | A1 * | 6/2007 | Vance | 343/702 |

FOREIGN PATENT DOCUMENTS

CN 1324012 A 11/2001

* cited by examiner

*Primary Examiner*—Hoang V Nguyen
*Assistant Examiner*—Robert Karacsony
(74) *Attorney, Agent, or Firm*—Haverstock & Owens LLP

(57) ABSTRACT

A frequency tunable internal antenna includes a substantially planar radiating element with a feed point and a switching element all coupled to the radiating element. The radiating element includes a plurality of slots configured to form a first branch and a second branch within the radiating element. The plurality of slots are configured relative to the feed point such that in operation the first branch acts as a first resonator having a first native electrical length and the second branch acts as a second resonator having a second native electrical length. The switching element is configurable in a first position and a second position, where in the first position the switching element connects to a portion of the first branch to decrease the electrical length of the first resonator, and in the second position the switching element connects to a portion of the second branch to decrease the electrical length of the second resonator. In some embodiments the antenna is a PIFA antenna and further includes a short point.

33 Claims, 5 Drawing Sheets

FREQUENCY TUNABLE PLANAR INTERNAL ANTENNA

PRIORITY CLAIM

This application claims benefit of priority under 35 U.S.C. Section 119(e) of the U.S. Provisional Patent Application Ser. No. 60/787,449, filed Mar. 29, 2006 and entitled "Frequency tunable PIFA-antenna for quad-band application," which is hereby incorporated by reference.

BACKGROUND OF THE INVENTION

Mobile device antennas have limited bandwidth. But increasingly, mobile devices, or mobile connectivity systems for portable devices, serve as primary communication devices. These devices, which include PDAs such as BlackBerry and notebook computers equipped with mobile connectivity cards, must handle relatively high bandwidth communications such as IMAP email, graphical web browsing, and the like, not to mention bandwidth intensive applications such as video streaming or IP telephony. Further, traditional mobile devices increasingly serve as sites of high-bandwidth activity such as video streaming, media messaging, and the like.

To support high bandwidth applications over mobile networks, mobile devices increasingly require innovative antennas that permit high bandwidth traffic over existing mobile communications infrastructure. Examples include the Enhanced Data Standard for GSM Evolution (EDGE), the General Packet Radio Service (GPRS) standard, and the Universal Mobile Telecommunications Standard (UMTS). These and others attempt to adapt new data needs to legacy wireless communications infrastructure including the global system for mobile communications (GSM850) or extended GSM (EGSM), the digital communication system (DCS), the personal communication system (PCS), and wide-band code-division multiple access (WCDMA). These attempts further strain antenna design—already subject to safety, cost, and size requirements or regulations—by requiring multiband or broadband resonance. Traditional antenna designs are unable to meet these requirements and hence alternative approaches are needed.

Planar antennas have features of low cost, low profile and light weight. Planar antenna performance depends, among other things, on the shape and dimensions of the antenna and slits or slots on ground planes. FIGS. 1 to 3 illustrate known configurations of planar inverted-F antennae (PIFA), all of which have an operating frequency band centered around a characteristic frequency.

FIG. 1 shows a planar inverted-F antenna (PIFA) antenna 100 comprising a planar electrically conductive radiating element 101, electrically conductive ground plane 102 parallel to the radiating element 101, and, connecting these two, a ground contact 103. The feed electrode 104 permits connection of the radiating element 101 to an antenna port of a radio apparatus (neither shown). The upper elements 101, 103, and 104 of the PIFA 100 are typically manufactured by progressive stamping processes applied to thin sheet metal. The lower ground plate is typically embodied as a plated area on the surface of a printed circuit board (PCB), which facilitates electrical coupling between the PCB and the upper elements of the PIFA.

FIG. 2 shows a PIFA structure 200 in accordance with European Patent Document No. 484,454 that is built around a dielectric body 204. The antenna consists of a radiating element 201, ground plane 202 and ground contact 203, each of which are plated onto the body 204. In this design, a feed element 205 electromagnetically coupled to the radiating element 201 feeds the antenna. The structure is mechanically sturdy, but the dielectric body block makes it relatively heavy. Further, the dielectric body narrows the impedance bandwidth of the antenna and degrades the radiation efficiency as compared to an air-insulated PIFA structure.

FIG. 3 shows a PIFA structure 300 structured around a radiating element 301. The radiating element 301 is generally rectangular, but forms a gap 302. The portions of the radiating element 301, including the strip 305, form an extended structure with an increased electrical length relative to a rectangle of the same size. This modification lowers the antenna's characteristic frequency.

However, these PIFA structures are not designed to fit in a small confined space while communicating efficiently in a wide frequency band.

One known class of PIFA designs provide increased bandwidth through a switchable antenna arrangement. These PIFA include a parasitic element that is connectable to a main radiator to alter the electrical length of the radiator and thus provide multiple frequency tuning for the antenna. For example, Milosavljevic in US Patent Application 2004/0207559 A1 describes a PIFA with a conductive parasitic element switchably coupled to ground, which alters the antenna's tuning when coupled to ground. When grounded, the parasitic element provides additional capacitance to the high-band resonator, which changes the electrical length of the high-band slot radiator and tunes the resonance frequency higher. Grounding the parasitic element also affects the tuning in the low-band slot. When grounded, the loading effect of the parasitic element is changed and thus changes the tuning of the low band slot.

A main drawback of this solution is that loading the radiator causes dissipation and reduces efficiency. Furthermore, many implementations of this concept require multiple switching elements, including in the matching circuitry for the antenna, which further reduce efficiency and add expense.

SUMMARY OF INVENTION

The embodiments of the present invention include switching methods that enable bandwidth-enhanced antenna designs with a single switching element. Further, preferred embodiments employ actuators coupled directly to the antenna's radiating element rather than through a parasitic coupling. The antenna designs described in this document are "planar" antennae. The term "planar antenna" doesn't refer only to antennae that are geometrically planar in shape, nor does it refer only to antennae that are composed of geometrically planar parts. Instead, a "planar" antenna has an extended shape that lies generally along a plane. For example, an antenna having three dimensions where one of the dimensions is an order of magnitude less than the other two dimensions is a planar antenna. Further, such an antenna can be composed of constituent parts that are only substantially planar, e.g. a radiating element that has two extended dimensions and one much shorter dimension.

For example, some embodiments of a frequency tunable, substantially planar internal antenna comprise a radiating element with a feed point and a switching element coupled to the radiating element. The radiating element includes a plurality of slots configured to form a first branch and a second branch within the radiating element. The feed point is configured relative to the plurality of slots such that in operation the first branch acts as a first resonator having a first native electrical length and the second branch acts as a second resonator having a second native electrical length. The switching element is configurable in a first position and a second position, where in the first position the switching element connects to a portion of the first branch to decrease the electrical length of the first resonator, and in the second position the switching element connects to a portion of the second branch to decrease the electrical length of the second resonator. In some embodiments, a short point is also included and configured to maintain the first and second resonators in a planar inverted-f antenna (PIFA) configuration.

Some other embodiments of a frequency tunable PIFA comprise a radiating element with a feed point and short point coupled to the radiating element, and a switching element connected to the radiating element. The radiating element includes a first slot and a second slot, wherein the first slot is configured to form a stem, first branch and a second branch within the radiating element and the second slot is configured to form a portion of the second branch into a primary sub-branch and a secondary sub-branch. The feed and short point are configured such that in operation the first branch acts as a first resonator having a first characteristic frequency and the second branch acts as a second resonator having a second characteristic frequency. The switching element is connected to the radiating element and configurable in a first position and a second position, where the first position forms a modified first resonator with a modified first characteristic frequency and the second position forms a modified second resonator with a modified second characteristic frequency.

Some additional embodiments of a frequency tunable internal antenna comprise a substantially planar radiating element that includes a first slot and a second slot. The first slot comprises a stem slot, a first sub-slot, and a second sub-slot. These divide the radiating element into a stem, a first branch, and a second branch. A first side of the stem slot and a first portion of the first sub-slot form an internal boundary of the first branch, and a second side of the stem slot, the second sub-slot and a second portion of the first sub-slot form a first internal boundary of the second branch. The second slot divides the second branch into a primary sub-branch and a secondary sub-branch. The second slot forms the internal boundary of the secondary sub-branch, and a second internal boundary of the primary sub-branch.

In addition, the antenna includes a feed element and a short element coupled to the stem of the radiating element. The antenna also includes a switching element configurable in a first position and a second position. In the first position the switching element galvanically connects a point on the stem to a point on the first branch, and in the second position the switching element galvanically connects the point on the stem to a point on the secondary sub-branch of the second branch.

Consistent with embodiments of the present invention, antennae as described herein are mounted in a variety of mobile communications devices, including mobile phones, mobile communications cards for portable computers, and portable digital assistants configured for mobile communications. The direct actuator techniques used in the present invention permit a single switching element to perform bandwidth-enhancement for multiple tuning slots within an internal antenna structure. For example, in a quad-band, dual tuning slot PIFA a directly-coupled actuator alternately shorts one or the other of the tuning slots. This alternate switching provides frequency shift in opposite directions for the low-band and high-band tuning slots, which is needed in some GSM networks.

DESCRIPTION OF THE SEVERAL DRAWING FIGURES

DETAILED DESCRIPTION OF THE EMBODIMENTS OF THE INVENTION

The description below concerns several embodiments of the invention. The discussion references the illustrated preferred embodiment. However, the scope of the present invention is not limited to either the illustrated embodiment, nor is it limited to those discussed, to the contrary, the scope should be interpreted as broadly as possible based on the language of the Claims section of this document.

Specifically, within the description an embodiment of the invention as a PIFA is illustrated. Other non-PIFA embodiments, for example where invention features are used in an internal planar monopole, are specifically included within the invention scope. Some of these are described but not shown, with differences relative to the illustrated PIFA pointed out where appropriate.

Structure

The embodiments of the present invention include planar internal antennae with switching elements directly mounted on a radiator. This situation is advantageous for various reasons discussed more fully elsewhere in this document.

Figure 1:
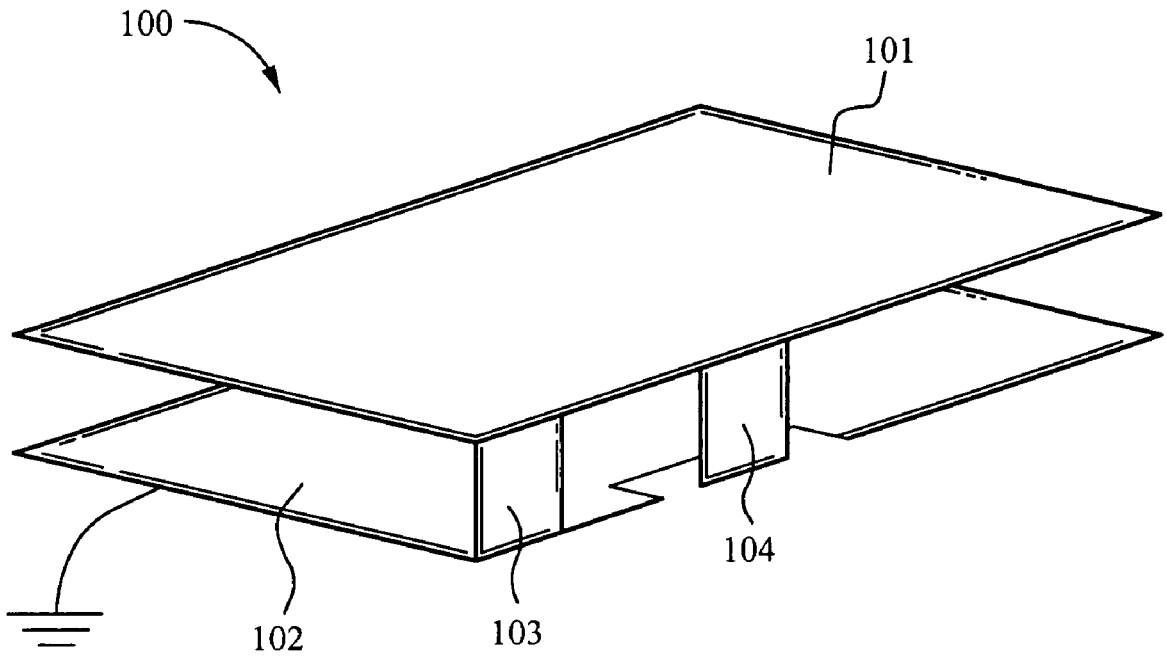
Fig. 1 (PRIOR ART)
FIG. 1 is a schematic illustration of a planar inverted-F antenna (PIFA) antenna.
Figure 2:
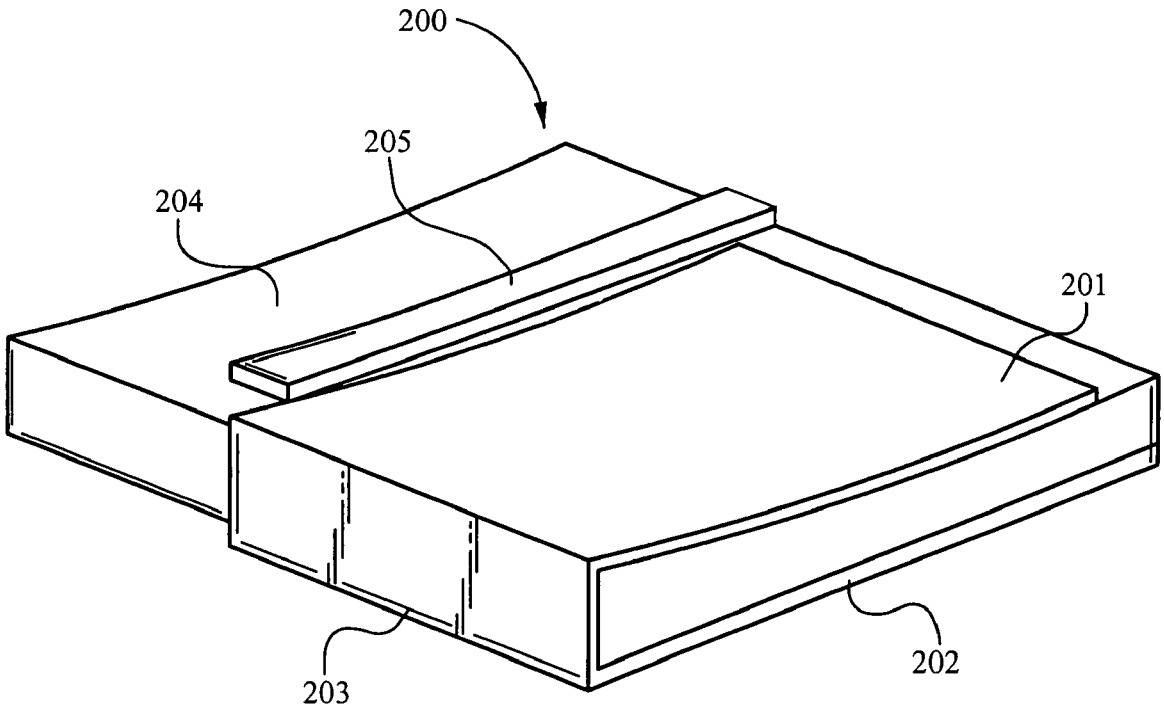
Fig. 2 (PRIOR ART)
FIG. 2 is a schematic illustration of a PIFA structure.
Figure 3:
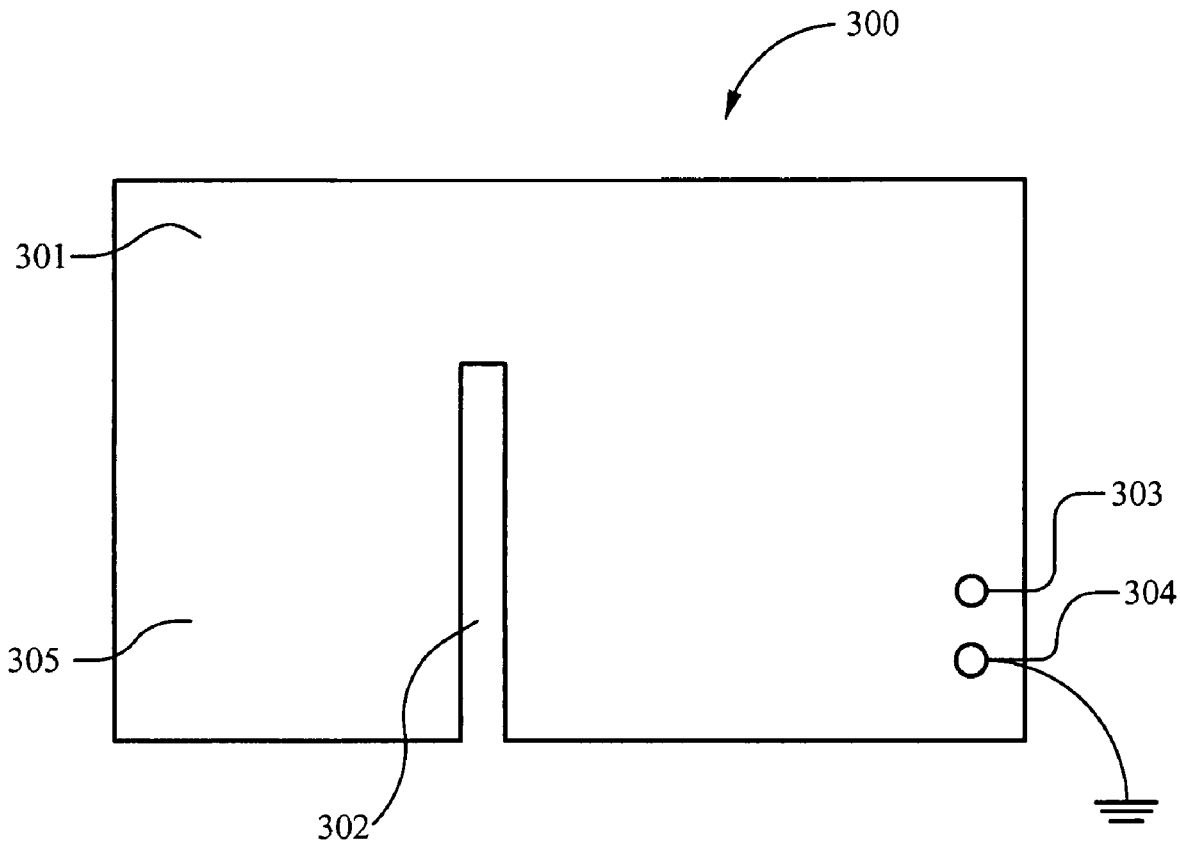
Fig. 3 (PRIOR ART)
FIG. 3 is a schematic illustration of a PIFA structure.
Figure 4:
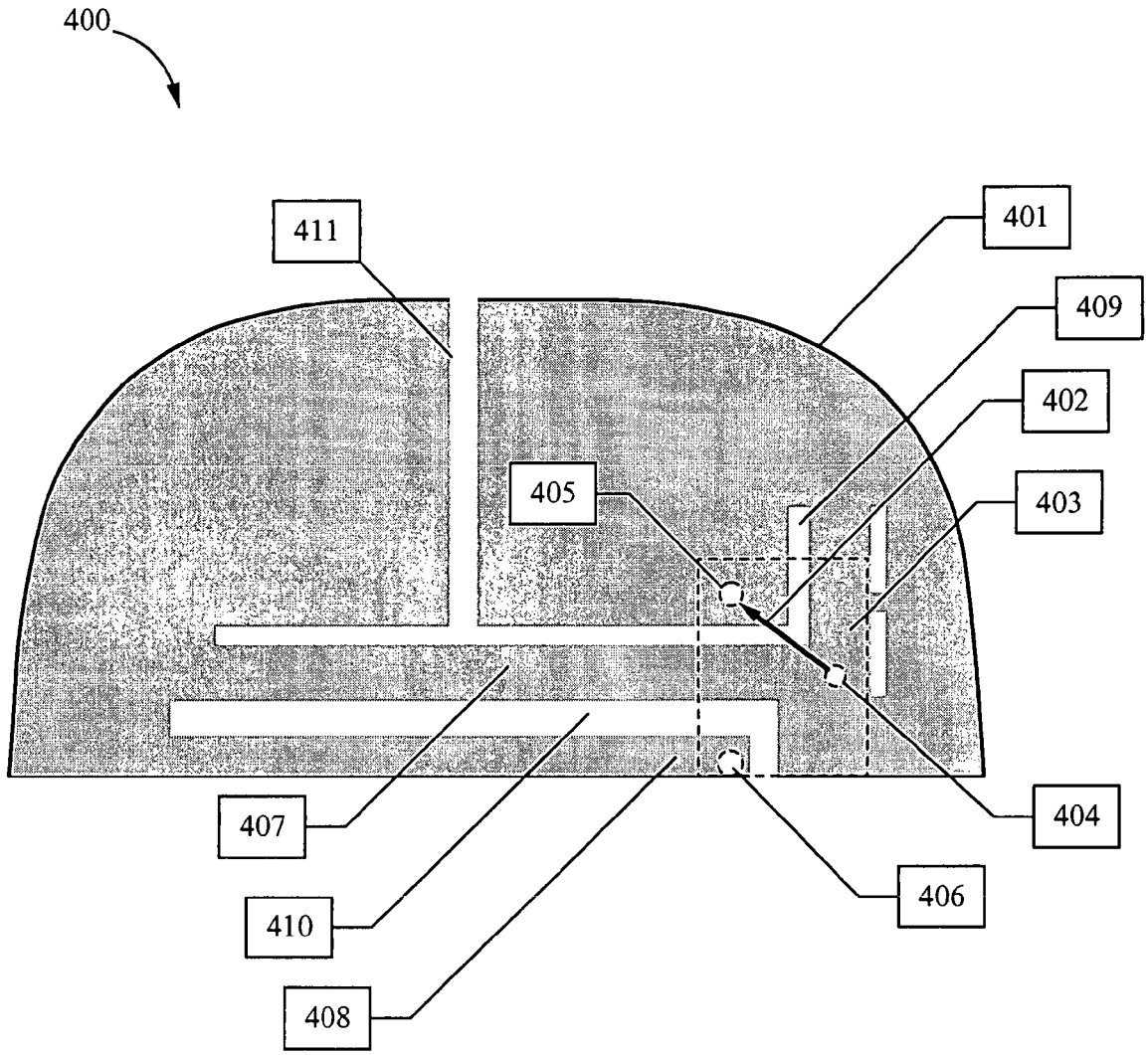
FIG. 4 illustrates a dual-band antenna consistent with some embodiments of the invention.

FIG. 4 shows an exemplary device of this type. FIG. 4 is a quad-band antenna with two tuning slots. The switching element permits quad-band operation of an antenna structure that would natively support only dual-band operation.

As shown in FIG. 4, the PIFA radiator 400 is implemented as a sheet of conducting material 401. Gaps within the sheet 401 serve as tuning slots 410 and 411. The remainder of the sheet 401 forms a collection of resonators for multi-band operation. The resonators are configured relative to a feed point and a short point of the PIFA, illustrated as white squares isolated within the radiator sheet 401.

Specifically, the first tuning slot 411 is arranged in a T-shape with its base at a long edge of the radiator sheet 401. The trunk of the "T" is the stem slot from which a first sub-slot and a second sub-slot extend in either direction. The first sub-slot extends toward the feed-short pair and includes a short slot 409 parallel to the stem slot. The first tuning slot 411 divides the radiator sheet 401 into a stem (containing the feed point and the short point), a first branch (adjacent to the first sub-slot, the short slot 409 and the stem slot), and a second branch (adjacent to the stem slot, the second sub-slot, and extending back toward the stem along both the first and second sub-slots). The first tuning slot 411 forms the internal boundary between the first branch and the second branch.

The second tuning slot 410 further divides the second branch into a primary sub-branch 407 (and the portion adjacent to the stem and first sub-slot), and a secondary sub-branch 408. The second tuning slot 410 forms the internal boundary between the secondary sub-branch 408 and the primary sub-branch 407.

The switching element 403 is arranged adjacent to the first branch, the stem, and the primary 407 as well as the secondary 408 sub-branches of the second branch. The switching element 403 includes the stem contact point 404, the first contact point 405, and the second contact point 406, as well as the connector 402. The connector 402 alternately couples the first contact point 405 to the stem contact point 404 and the second contact point 406 to the stem contact point 404.

The first contact point 405 is sited on the first branch and configured to short out the short slot 409 when it is electrically connected to the stem contact point 404 by the connector 402. When the connector 402 is connecting the first contact point 405 to the stem contact point 404, the switching element 403 is in a first position. In this first position, the connector 402 effectively removes the short section 409 from the first sub-slot and decreases the electrical length of the first branch.

The second contact point 406 is sited on the secondary branch 408 and configured to short out the second slot 410 when it is electrically connected to the stem contact point 404 by the connector 402. When the connector 402 is connecting the second contact point 406 to the stem contact point 404, the switching element 403 is in a second position. In this second position, the connector 402 effectively removes the second tuning slot from the second branch and decreases the electrical length of the second branch.

In some non-PIFA embodiments, the feed-short pair is replaced by a single feed point. In such designs, the impedance matching circuitry and frequency-design of the antenna must be modified appropriately to achieve desired resonator performance.

Preferably, the sheet 401 is formed from conducting material on a flexible printed circuit board (PCB). The sheet 401 is preferably substantially planar; however in some embodiments, a relatively non-planar sheet is used. In some embodiments the material is deposited onto the PCB to form the structure shown. In some other embodiments, the material is deposited in a uniform sheet and material is removed to form the illustrated structure, e.g. the slots 410 and 411 are formed via material removal. Exemplary methods of material removal include wet etching, dry etching, machining, plasma etching, photolithographic methods, and the like. In other embodiments the sheet 401 is formed of a thin layer of metal with inherent structural integrity, e.g. thin metal foil.

The switching element 403 of the present invention can be implemented with various type switches. A microelectromechanical system (MEMS) type switch can be utilized. In using a MEMS switch, a contact element is anchored at the stem contact point 404 and another element moves alternatively between either the first contact point 405 or the second contact point 405. In some embodiments, the MEMS switching is controlled to depend on the voltage and corresponding electrostatic attraction supplied to the first or second contact point. Alternatively, a semiconductor switch is used. In some embodiments, a mechanical relay switch is used. For example, one implementation anchors an end of a mechanical relay to the stem contact point 404 and connects the other end either with the first contact point 405 or the second contact point 406. Of course, other types of switches known to those skilled in the art may be utilized to alternatively connect the stem contact point 404 with first and second contact points.

Function

Direct mounting of a switching element on the radiator permits dynamic reconfiguration of the radiator's various conducting branches, thereby altering the tuning of the PIFA. Each position of the switching element is associated with a set of characteristic tuning frequencies for the PIFA. Preferably, the set of tunings associated with a particular position comprises a collection of tunings appropriate for a selected standard for mobile communications in a geographic service region. Further, all the positions are preferably configured for the same selected mobile communications standard (or set of selected standards or type of standard), but each position preferably relates to a unique geographic service region. Thereby, the set of positions permits operation over a variety of geographic service regions on a selected type of mobile communications standard.

In operation the PIFA 400 is energized by EM radiation and through the feed point. The orientation of the branches of the sheet 401 formed by the first tuning slot 411 and the second tuning slot 410, which are described in detail above, relative to the feed point and short point of the PIFA, illustrated as white squares isolated within the radiator sheet 401, determines in part their frequency and tuning characteristics. The positioning of the switching element 403 modifies the 'native' tuning characteristics of the PIFA radiating sheet 401. 'Native' refers to the tuning characteristics of the sheet and slot formation absent the switching element 403.

In some non-PIFA embodiments, the feed-short pair is replaced by a single feed point. In such designs, the configuration of the first tuning slot 411 and the second tuning slot 410 relative to the feed point alone account for the frequency and tuning characteristics of the resonators. In such embodiments, matching circuitry and frequency-design of the antenna must be modified appropriately to achieve desired resonator performance.

In operation, e.g. with the PIFA 400 being energized through the feed point and by EM radiation, the feed the first branch acts as a first resonator having a first characteristic frequency. Similarly, the second branch, including both the primary sub-branch 407 and the secondary sub-branch 408, acts as a second resonator having a second characteristic frequency. However, because the switching element 403 must be in either the first position or the second position in this embodiment, the PIFA 400 never operates at both the first characteristic frequency and the second characteristic frequency simultaneously.

In the first position, the switching element 403 connects the stem contact point 404 to the first contact point 405, shorting out the short slot 409, decreasing the electrical length of the first branch, and forming a modified first resonator with a modified first characteristic frequency. The modified first characteristic frequency is higher than the first characteristic frequency.

Similarly, in a second position, the switching element 403 connects the connects the stem contact point 404 to the second contact point 406, shorting out the second tuning slot 410, decreasing the electrical length of the second branch, and forming a modified second resonator with a modified second characteristic frequency. The modified second characteristic frequency is higher than the second characteristic frequency.

Thus, in the first position the PIFA 400 operates with a modified first resonator and a native second resonator. The modified first resonator tunes around a modified first characteristic frequency and comprises the first branch as connected to the stem by the switching element 403. The second resonator tunes around a second characteristic frequency and comprises the second branch including the primary sub-branch and the secondary sub-branch.

In the second position the PIFA 400 operates with a native first resonator and a modified second resonator. The modified second resonator tunes around a modified first characteristic frequency and comprises the second branch where the secondary sub-branch is connected to the stem by the switching element 403. The first resonator tunes around a first characteristic frequency and comprise the first branch including the portion adjacent to the short slot 409.

Preferably the antenna is tuned so that the first and modified first characteristic frequencies are higher relative to the second and modified second characteristic frequencies. Further, the first position preferably tunes both the high and low bands to USA GSM standard tuning bands. In addition the second position preferably tunes both the high and low bands to European GSM standard tuning bands.

Thus, the modified first characteristic frequency falls in the range of the higher frequency band of the USA GSM standard, GSM 1850 or 1850-1910 MHz, and the second characteristic frequency falls in the range of the lower frequency band of the USA GSM standard, GSM 850 or 824-849 MHz. Similarly, the first characteristic frequency falls in the range of the higher frequency band of the European GSM standard, GSM 1800 or 1710-1785 MHz, and the modified second characteristic frequency falls in the range of the lower frequency band of the USA GSM standard, GSM 900 or 890-915 MHz.

Figure 5:
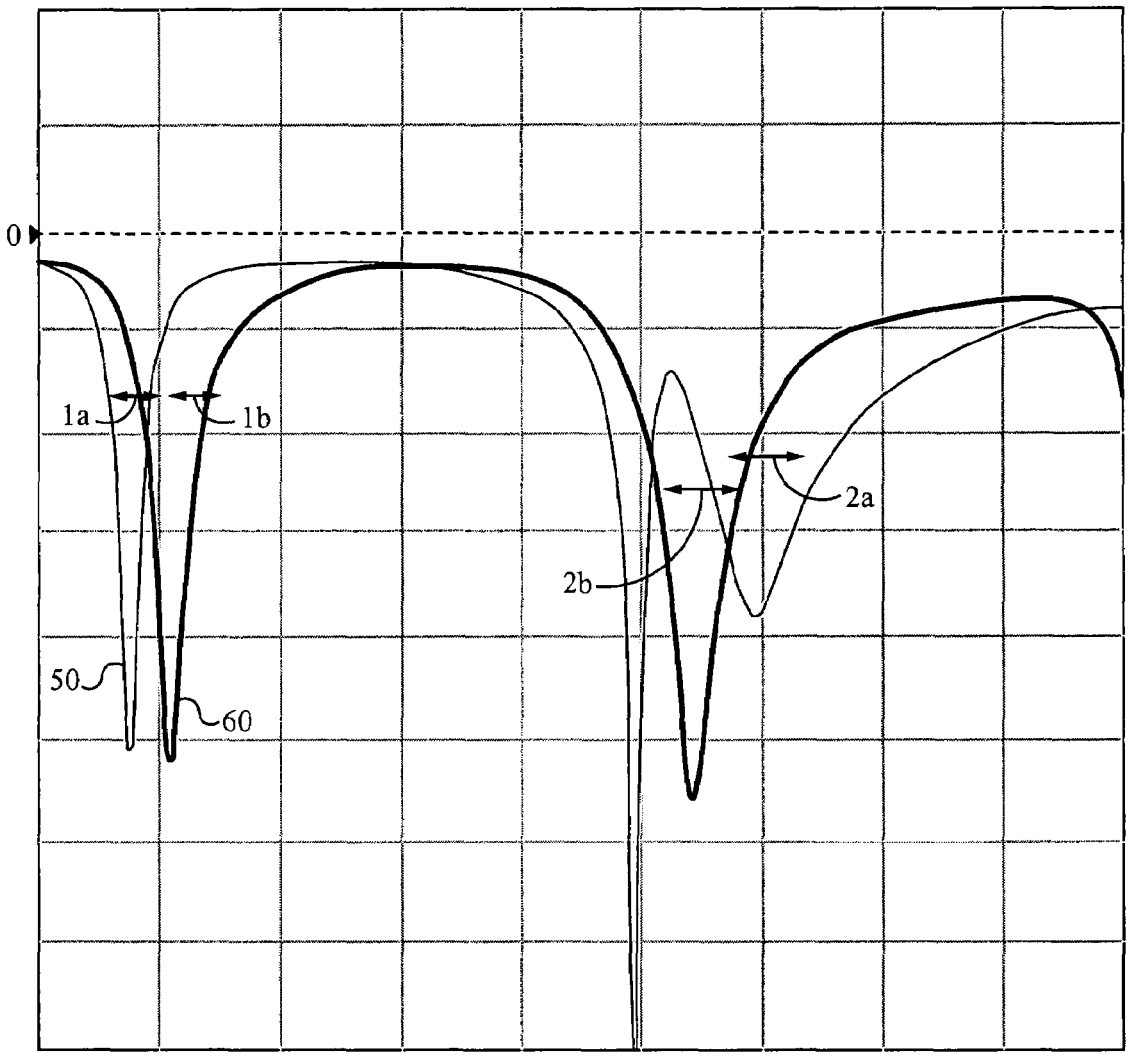
FIG. 5 is a graph of performance of a dual-band antenna consistent with some embodiments of the invention.

FIG. 5 illustrates antenna performance for the PIFA 400. The vertical axis is proportional to magnitude of reflectance, lower numbers indicate higher performance, and the horizontal axis is proportional to frequency, e.g. MHz.

A first histogram line 50 indicates performance with the switching element in the first position. Here, the antenna tunes effectively in a first frequency band 1*a* and a second frequency band 2*a*. In the second position, indicated by line 60, the effective tuning bands shift in opposite directions. The antenna position indicated by 60 provides effective tuning in the modified first frequency band 1*b* and the modified second frequency band 2*b*. For example, the frequency bands indicated on the histogram of FIG. 5 could be USA and European GSM bands.

The embodiments of the present invention provide bandwidth broadening substantially without the monetary, size, or efficiency penalties inherent in previous solutions. The connected switching element provides a versatile solution that doesn't incur the loading penalties of EM-coupled parasitic switching.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

We claim:

1. A frequency tunable, substantially planar, internal antenna, comprising:

a. a radiating element including a plurality of slots configured to form a first branch and a second branch within the radiating element;

b. a feed point coupled to the radiating element and configured relative to the plurality of slots such that in operation the first branch acts as a first resonator having a first native electrical length and the second branch acts as a second resonator having a second native electrical length; and c. a switching element coupled to the radiating element and configurable in a first position and a second position, where in the first position the switching element connects to a portion of the first branch, forming a connection between two points on the radiating element thereby decreasing the electrical length of the first resonator, and in the second position the switching element connects to a portion of the second branch, forming a connection between two points on the radiating element thereby decreasing the electrical length of the second resonator.

2. The internal antenna of claim 1, wherein the plurality of slots further forms a stem in addition to the first branch and the second branch.

3. The internal antenna of claim 2, wherein the feed point is coupled to the radiating element at a point on the stem.

4. The internal antenna of claim 2, wherein the switching element is continuously connected to a point on the stem.

5. The internal antenna of claim 2, further comprising a short point coupled to the stem of the radiating element and configured to place the first resonator and the second resonator in a planar inverted-f antenna configuration.

6. The internal antenna of claim 1, wherein the second branch comprises a primary sub-branch and a secondary sub-branch.

7. The internal antenna of claim 6, where in the second position the switching element connects to a point on the secondary sub-branch.

8. The internal antenna of claim 1, wherein the switching element is a microelectromechanical switch.

9. The internal antenna of claim 1, wherein the switching element is a semiconductor switch.

10. The internal antenna of claim 1, wherein the switching element is an electromechanical switch.

11. The internal antenna of claim 1, wherein the radiating element is formed of a thin layer of conducting material deposited on a printed circuit board.

12. The internal antenna of claim 1, wherein the radiating element is formed of a thin layer of conducting material with inherent structural integrity.

13. The internal antenna of claim 1, wherein the decreased electrical length with the switching element in the first position enables the first resonator to tune in the GSM 1850 band.

14. The internal antenna of claim 1, wherein the second native electrical length enables the second resonator to tune in the GSM 850 band.

15. The internal antenna of claim 1, wherein the first native electrical length enables the first resonator to tune in the GSM 1800 band.

16. The internal antenna of claim 1, wherein the decreased electrical length with the switching element in the second position enables the second resonator enables to tune in the GSM 900 band.

17. The internal antenna of claim 1, mounted in a mobile phone.

18. The internal antenna of claim 1, mounted in a mobile communications card for a portable computer.

19. The internal antenna of claim 1, mounted in a portable digital assistant configured for mobile communications.

20. The internal antenna of claim 1, wherein the radiating element is planar.

21. A frequency tunable planar inverted-f antenna (PIFA), comprising:

a. a radiating element including a first slot and a second slot, wherein the first slot is configured to form a stem, first branch and a second branch within the radiating element, and the second slot is configured to form a portion of the second branch into a primary sub-branch and a secondary sub-branch;

b. a feed point coupled to the stem of the radiating element;

c. a short point coupled to the stem of the radiating element and configured relative to the feed point such that in operation the first branch acts as a first resonator having a first characteristic frequency and the second branch acts as a second resonator having a second characteristic frequency; and d. a switching element connected to the radiating element and configurable in a first position and a second position, where the first position forms a connection between two points on the radiating element, forming a modified first resonator with a modified first characteristic frequency and the second position forms a connection between two points on the radiating element, forming a modified second resonator with a modified second characteristic frequency.

22. The frequency tunable PIFA of claim 21, wherein the first position of the switching element connects the stem of the radiating element to a point on the first branch.

23. The frequency tunable PIFA of claim 21, wherein the second position of the switching element connects the stem of the radiating element to a point on the secondary sub-branch.

24. The frequency tunable PIFA of claim 21, wherein the switching element is a microelectromechanical switch.

25. The frequency tunable PIFA of claim 21, wherein the switching element is a semiconductor switch.

26. The frequency tunable PIFA of claim 21, wherein the switching element is an electromechanical switch.

27. The frequency tunable PIFA of claim 21, wherein the radiating element is formed of a thin layer of conducting material deposited on a printed circuit board.

28. The frequency tunable PIFA of claim 21, wherein the radiating element is formed of a thin layer of conducting material with inherent structural integrity.

29. The frequency tunable PIFA of claim 21, wherein the modified second characteristic frequency and the first characteristic frequency correspond to a set of suitable frequencies for operation on a known mobile communications standard set for a geographic service region.

30. The frequency tunable PIFA of claim 29, wherein the set of suitable frequencies is GSM 900 and GSM 1800 and the geographic service region is Europe.

31. The frequency tunable PIFA of claim 21, wherein the modified first characteristic frequency and the second characteristic frequency correspond to a set of suitable frequencies for operation on a known mobile communications standard set for a geographic service region.

32. The frequency tunable PIFA of claim 31, wherein the set of suitable frequencies is GSM 850 and GSM 1850 and the geographic service region is the United States.

33. A frequency tunable internal antenna, comprising:

a. a substantially planar radiating element including:

i. a first slot comprising a stem slot, a first sub-slot, and a second sub-slot that divide the radiating element into a stem, a first branch, and a second branch, wherein a first side of the stem slot and a first portion of the first sub-slot form an internal boundary of the first branch, and a second side of the stem slot, the second sub-slot and a second portion of the first sub-slot form a first internal boundary of the second branch;

ii. a second slot that divides the second branch into a primary sub-branch and a secondary sub-branch wherein the second slot forms the internal boundary of the secondary sub-branch, and a second internal boundary of the primary sub-branch;

b. a feed element coupled to the stem of the radiating element;

c. a short element coupled to the stem of the radiating element;

d. a switching element configurable in a first position and a second position, where in the first position the switching element galvanically connects a point on the stem to a point on the first branch thereby decreasing the electrical length of the first branch, and in the second position the switching element galvanically connects the point on the stem to a point on the secondary sub-branch of the second branch thereby decreasing the electrical length of the second branch.

* * * * *